US007254910B2

(12) United States Patent
Guzman

(10) Patent No.: US 7,254,910 B2
(45) Date of Patent: Aug. 14, 2007

(54) FOOTWEAR WITH EXTERNALLY ACTIVATED SWITCH

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 666 days.

(21) Appl. No.: 10/852,084

(22) Filed: May 24, 2004

(65) Prior Publication Data

US 2005/0150139 A1 Jul. 14, 2005

Related U.S. Application Data

(63) Continuation-in-part of application No. 10/753,679, filed on Jan. 8, 2004, now Pat. No. 7,096,607.

(51) Int. Cl.
*A43B 23/00* (2006.01)

(52) U.S. Cl. ..... 36/136; 36/137; 36/139

(58) Field of Classification Search ..... 36/136, 36/137, 139; 362/103
See application file for complete search history.

(56) References Cited

U.S. PATENT DOCUMENTS

| | | | | |
|---|---|---|---|---|
| 2,940,184 | A | 6/1960 | Malone | 36/1 |
| 4,043,241 | A | 8/1977 | Liu | 84/1.01 |
| 4,207,087 | A | 6/1980 | Morrison et al. | 273/1 E |
| 4,646,350 | A | 2/1987 | Batra | 381/51 |
| 4,771,556 | A | 9/1988 | Kim | 36/139 |
| 5,159,768 | A | 11/1992 | Longo, Jr. | 36/139 |
| 5,343,190 | A | 8/1994 | Rodgers | 340/573 |
| 5,345,700 | A | 9/1994 | Norment | 36/139 |
| 5,381,615 | A | 1/1995 | MacMillan | 36/137 |
| 5,402,590 | A | 4/1995 | Lee | 36/139 |
| 5,422,628 | A | 6/1995 | Rodgers | 340/573 |
| 5,483,759 | A | 1/1996 | Silverman | 36/137 |
| 5,530,626 | A | 6/1996 | Norment | 361/814 |
| 5,649,376 | A | 7/1997 | Lecates, Jr. | 36/137 |
| 5,714,706 | A | 2/1998 | Nakada et al. | 84/730 |
| 5,765,300 | A | 6/1998 | Kianka | 36/139 |
| 5,812,063 | A | 9/1998 | Weng et al. | 340/815.45 |
| 5,813,148 | A | 9/1998 | Guerra | 36/137 |
| 5,855,080 | A | 1/1999 | Van Staden | 36/139 |
| 5,860,727 | A | 1/1999 | Chien | 362/84 |
| 5,894,201 | A | 4/1999 | Wong | 315/241 S |
| 5,909,088 | A | 6/1999 | Wut | 315/200 A |
| 5,969,479 | A | 10/1999 | Wong | 315/200 A |
| 6,000,149 | A | 12/1999 | Pomerantz | 36/139 |
| 6,012,822 | A | 1/2000 | Robinson | 362/103 |
| 6,030,106 | A | 2/2000 | Johnson | 362/500 |
| 6,053,622 | A | 4/2000 | Horowitz et al. | 362/276 |

(Continued)

FOREIGN PATENT DOCUMENTS

| | | |
|---|---|---|
| DE | 35 05 943 A1 | 8/1986 |

(Continued)

*Primary Examiner*—Marie Patterson
(74) *Attorney, Agent, or Firm*—GrayRobinson, P.A.

(57) ABSTRACT

An article of footwear includes an electrical circuit having a battery, one or more integrated circuits connected to an array of LEDs and to a loudspeaker, and, a number of switches which are operative to activate the integrated circuit(s) in response to motion of the footwear and/or the application of a magnetic field from a permanent magnet located externally of the article of footwear.

15 Claims, 5 Drawing Sheets

U.S. PATENT DOCUMENTS

| | | | | |
|---|---|---|---|---|
| 6,238,056 | B1 | 5/2001 | Ripasarda | 362/103 |
| 6,286,975 | B1 | 9/2001 | Rodgers | 362/103 |
| 6,315,571 | B1 | 11/2001 | Lee | 434/250 |
| 6,525,487 | B2 | 2/2003 | Wei | 315/200 A |
| 7,096,607 | B2 * | 8/2006 | Guzman | 36/137 |
| 2002/0047646 | A1 | 4/2002 | Lys et al. | 315/312 |
| 2002/0048169 | A1 | 4/2002 | Dowling et al. | 362/234 |
| 2002/0070666 | A1 | 6/2002 | Dowling et al. | 315/312 |
| 2003/0137258 | A1 | 7/2003 | Piepgras et al. | 315/291 |
| 2004/0251631 | A1 | 12/2004 | Chou | 273/378 |

FOREIGN PATENT DOCUMENTS

| | | |
|---|---|---|
| DE | 203 17 143 U1 | 4/2004 |

* cited by examiner

FOOTWEAR WITH EXTERNALLY ACTIVATED SWITCH

RELATED APPLICATION

This application is a continuation-in-part of U.S. patent application Ser. No. 10/753,679 filed Jan. 8, 2004 and entitled "Clothing With Externally Activated Switch," which is assigned to the same assignee as the present invention, now U.S. Pat. No. 7,096,607.

FIELD OF THE INVENTION

This invention relates to footwear, and, more particularly, to a shoe having an array of light sources such as LEDs which are illuminated in response to motion of the shoe, and a loudspeaker activated as a result of placing a magnetic field from an external source into proximity with indicia of different shapes mounted to the shoe.

BACKGROUND OF THE INVENTION

For a number of years, articles of footwear and various items of clothing have been sold with decorative arrays of light sources such as light emitting diodes (LEDs) and/or a loudspeaker capable of producing a sound. This has be en particularly popular in children's shoes where the LEDs are arranged to complement other design elements of the shoe such as cartoon characters and the like.

In a typical design of a children's shoe of the type noted above, a module including a plastic housing is placed in a cavity usually formed in the heel area of the shoe. The module mounts a battery, a switch and conventionally an integrated circuit which is connected by wires to LEDs positioned along the outsole, upper or tongue of the shoe. The integrated circuit may also be capable of generating a signal which operates a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for children's shoes and other applications are activated by the switch associated with the module. In most designs, the switch is not operated manually but turns on and off in response to the application of an inertial force, pressure or motion. Spring switches such as shown in U.S. Pat. Nos. RE37,220 and 5,909,088 are a popular choice for children's shoes because they are reliable, noiseless and movable from a neutral or off position to a closed or on position in response to walking, running or other motion of the shoe. Pressure switches such as shown in U.S. Pat. Nos. 5,159,768; 5,649,376; 5,855,080 and 5,714,706 are also employed and they operate in response to the application of a force, e.g. when the child steps onto a surface.

Another type of switch employed in children's shoes and similar applications is a magnetically activated switch such as shown in U.S. Pat. Nos. 5,422,628 and 5,343,190. In these designs, a reed switch and a permanent magnet are mounted within the heel or other area of the shoe. The magnet is movable between a first position where it is spaced from the reed switch and a second position close to the reed switch. A spring normally biases the magnet to the first position, but when motion or an inertial force is applied to the shoe, the magnet overcomes the spring force and moves to the second position where its magnetic field causes the reed switch to close. Closure of the reed switch causes lights and/or a loudspeaker mounted to the shoe to be activated.

SUMMARY OF THE INVENTION

This invention is directed to an article of footwear, and a module mounted to the article of footwear having an electrical circuit including a battery, one or more integrated circuits connected to an array of LEDs and to a loudspeaker, and, a number of switches which are operative to activate the integrated circuits in response to motion of the footwear and/or the application of a magnetic field from a permanent magnet located externally of the article of footwear.

In one presently preferred embodiment, the module includes a plastic housing which mounts an electrical circuit including a battery, a lighting integrated circuit coupled to a number of LEDs and a sound integrated circuit coupled to one or more loudspeakers. A spring switch is connected between the battery and the lighting integrated circuit which turns on and off in response to the application of motion or an inertial force to the article of footwear or shoe e.g. by walking, running or other motion. Operation of the spring switch activates the lighting integrated circuit which is effective to cause the LEDs to illuminate in a flashing or other lighting sequence for a predetermined period of time.

A second magnetically activated switch, preferably a reed switch, is mounted to the module or within a separate casing in the shoe. The reed switch is formed with cooperating contacts which are movable relative to one another under the influence of a magnetic field from a separated or open position to a closed position where they engage one another. In order to move the contacts of the reed switch to the closed position, a magnetic field is applied in proximity to the shoe, preferably by a permanent magnet. In one embodiment, closure of the reed switch causes a circuit connection to be made wherein both the sound integrated circuit and the light integrated circuit are activated, thus causing both the LEDs and the loudspeaker to operate at the same time. Alternatively, closing of the reed switch activates only the loudspeaker.

In an alternative embodiment, the electrical circuit includes the same light integrated circuit noted above but employs a different sound integrated circuit. Preferably, the upper of the shoe mounts a number of indicia in the form of sections of cloth, plastic or similar material which are formed in or marked with a different shape. Each indicia is connected to or integrally formed with a reed switch, or other magnetically activated switch. These switches, in turn, are coupled to the sound integrated circuit. In response to the placement of a magnetic field in the proximity of any of the indicia by an external, permanent magnet or the like, the switch associated with such indicia activates the sound integrated circuit. The sound integrated circuit causes the loudspeaker to sound a message identifying a particular sequence of the indicia. The child must then pass the permanent magnet over each indicia and their associated switches, in the sequence in which they were named, to activate the sound integrated circuit so that the loudspeaker sounds a positive message of approval. If the child fails to correctly recognize the shapes of the indicia and passes the magnet over them out of sequence, then a message such as "try again" is sounded by the loudspeaker. The sound integrated circuit may be programmed to repeat this process more than once after initial activation of the switch associated with one of the indicia, if desired, before the sound integrated circuit resets.

The application of a magnetic field externally of a shoe to activate the loudspeaker, and in one embodiment both the loudspeaker and LEDs, adds an element of fun and excitement to the shoe of this invention, particularly for young children. A permanent magnet capable of closing the reed switch may be housed in a wand or other toy item which the child "waves" over the shoe in the area of the reed switch to close it, further adding to the enjoyment of wearing and playing with the shoes of this invention.

DESCRIPTION OF THE DRAWINGS

The structure, operation and advantages of the presently preferred embodiments of this invention will become further apparent upon consideration of the following description, taken in conjunction with the accompanying drawings, wherein.

DETAILED DESCRIPTION OF THE INVENTION

Figure 1:
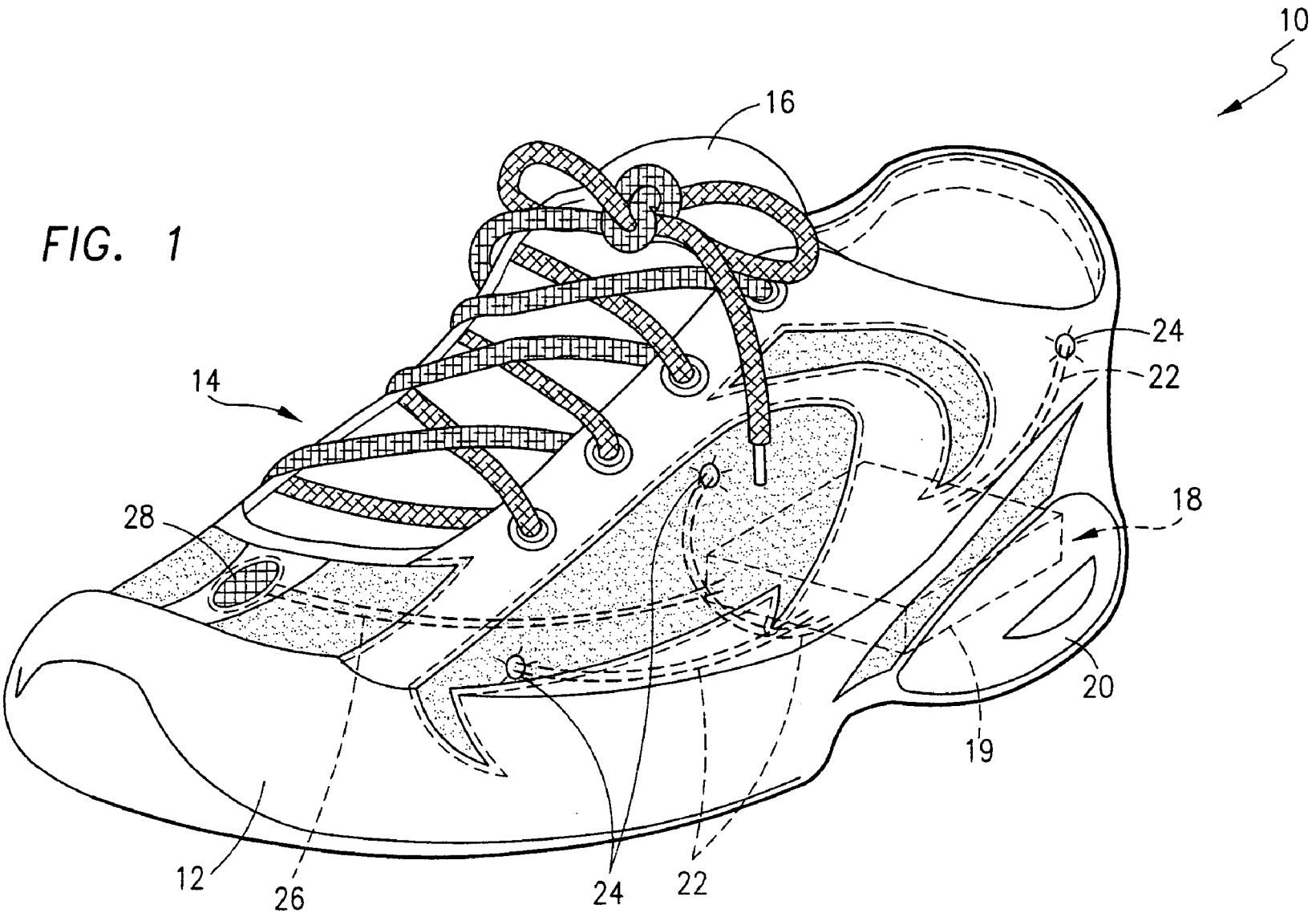
FIG. 1 is a perspective view of one embodiment of a shoe containing a module which is connected to an array of LEDs and to a loudspeaker both mounted to the upper of the shoe.
Figure 2:
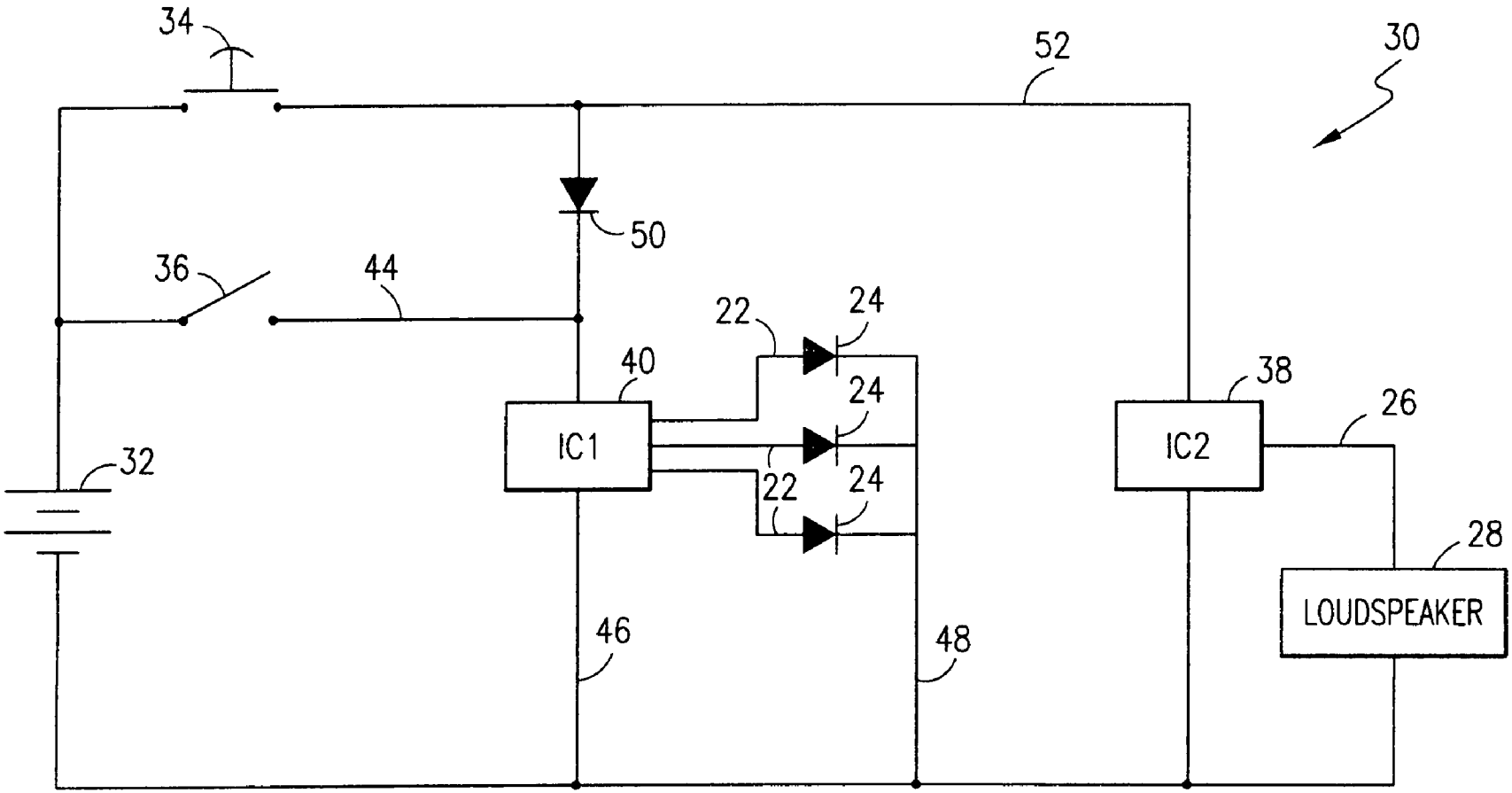
FIG. 2 is a schematic circuit diagram of one embodiment of the electrical circuit of this invention including the LEDs and loudspeaker shown in FIG. 1.

Referring initially to FIGS. 1 and 2, a shoe 10 is shown having an outsole 12 connected to an upper 14 including a tongue 16. It should be understood that essentially any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

A module 18 having a housing 19 preferably made of plastic is mounted in the heel 20 of the shoe 10. A cavity (not shown) is hollowed out of the heel 20 to receive the module 18, over which the sock liner or insole of the shoe 10 is secured. As schematically illustrated in FIG. 1, the module 18 is coupled by wires 22 to an array of LEDs 24 mounted to the upper 14 of the shoe 10, and by a wire 26 to a loudspeaker 28 also carried by the upper 14. The particular location or arrangement of the LEDs 24 on the shoe 10 is a matter of choice, and it is contemplated they could be placed on the outsole 12, tongue 16 and in essentially any other position on the shoe 10. The loudspeaker 28 is preferably mounted to the tongue 16 or some area of the upper 14, rather than on the outsole 12.

An electrical circuit 30 is schematically depicted in FIG. 2 which includes a battery 32, a reed switch 34, a spring switch 36, a sound integrated circuit (IC) 38 (IC 1), a lighting integrated circuit 40 (IC 2) and the LEDs 24 and loudspeaker 28. The battery 32, ICs 38, 40 and spring switch 36 are preferably mounted on the module 18, with the wire 26 connecting the sound IC 38 to the loudspeaker 28 and the wires 22 connecting the lighting IC 40 to the LEDs 24. The reed switch 34 may be carried by the module 18, or, alternatively, it may be mounted within a separate casing 42 as described below in connection with a discussion of FIGS. 5 and 6.

In the embodiment of FIGS. 1 and 2, the spring switch 36 is connected by a line 44 between one terminal of the battery 32 and the lighting IC 40, which, in turn, is connected by line 46 to the opposite terminal of the battery 32. As noted above, wires 22 connect the lighting IC 40 with the LEDs 24 and they are connected via lines 48 and 49 to the battery 32. The reed switch 34 is connected through a diode 50 to the lighting IC 40, and by line 52 to the sound IC 38. Both the sound IC 38 and loudspeaker 28 are connected to the battery 32, as schematically shown in FIG. 2.

The detailed construction of the spring switch 36, sound IC 38 and lighting IC 40 forms no part of this invention and is therefore not discussed herein. Each of these elements is known in the art and commercially available. One type of spring switch 36 suitable for use in the module 18 is disclosed in U.S. Pat. No. 5,408,764. The sound IC 38 is available under part number 66391, and the lighting IC 40 is available under part number 6608, both from Cheerine Development (Hong Kong) Ltd., having a place of business at Room 1217, North Tower, Concordia Plaza, No. 1 Science Museum Road, Tsim Sha Tsui East, Kowloon, Hong Kong. Depending upon the particular sound IC 38 selected, a sound is produced by the loudspeaker 28 such as a race car, a song etc. The lighting IC 40 is effective to illuminate the LEDs 24 in one or more flashing or other lighting sequence of predetermined duration.

Figure 5:
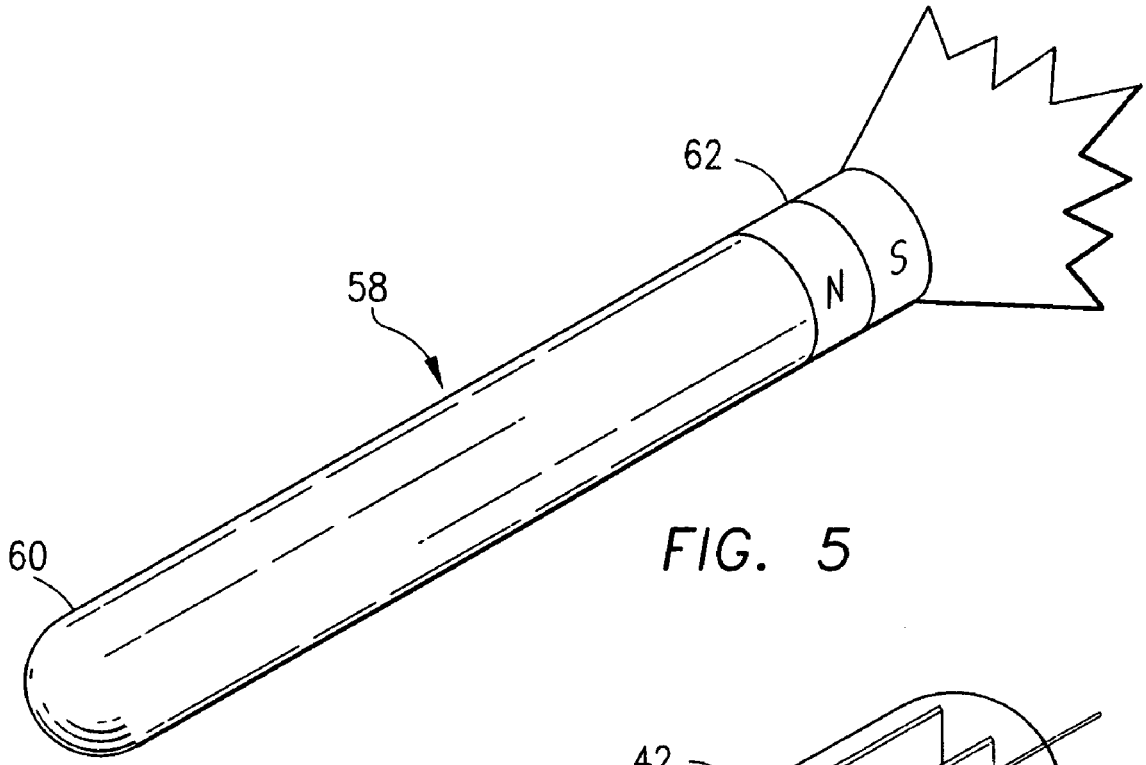
FIG. 5 is a perspective view of a wand which mounts a permanent magnet.
Figure 6:
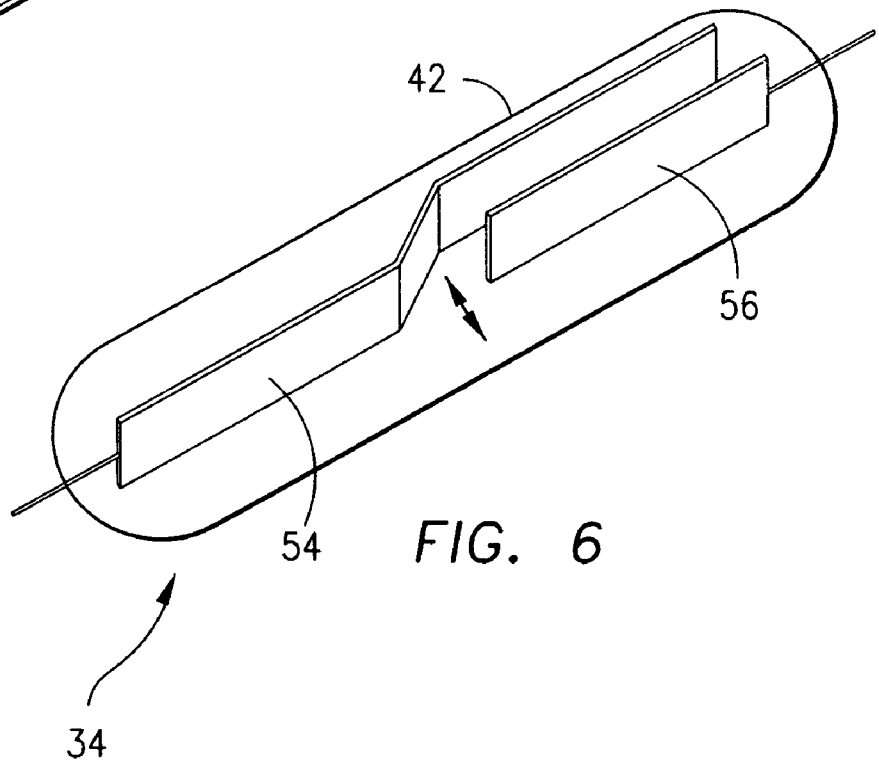
FIG. 6 is a schematic view of a reed switch which is closed by the permanent magnet depicted in FIG. 5.

The reed switch 34 is of conventional construction as shown in FIG. 6. It includes a first contact 54 and a second contact 56 which are spaced from one another within casing 42. Each of the contacts 54 and 56 is formed of a metal which is movable under the influence of a magnetic field. For purposes of illustration, a wand 58 is depicted in FIG. 5 having a handle 60 which mounts a permanent magnet 62 at one end. Essentially any other kind of toy or other holder could be employed to mount the permanent magnet 62, and the wand 58 is shown for purposes of illustration only.

The electrical circuit of FIG. 2 of this invention operates as follows. The spring switch 36 is connected between one terminal of the battery 32 and the lighting IC 40, which, in turn, connects to the other battery terminal. In response to the application of an inertial force or motion to the spring switch 36, it operates to electrically connect the battery 32 with the lighting IC 40. This activates the lighting IC 40 which is effective to illuminate the LEDs 24 connected thereto in a particular flashing or other lighting sequence.

The reed switch 34 employed in the shoe 10 of this invention is not operated in response to the application of pressure, an inertial force, motion or the like. Instead, the contacts 54 and 56 of the reed switch 34 are movable into engagement with one another in response to the application of a magnetic field. This magnetic field is provided by the permanent magnet 62 carried at the end of wand 58. The wand 58 is grasped by its handle 60 and placed at a location on the outside of the shoe 10 in proximity to where the reed switch 34 is mounted. The wand 58 and magnet 62 are then moved relative to the shoe 10 and the reed switch 34 so that the magnetic field of the magnet 62 causes the contacts 54, 56 of the reed switch 34 to engage one another. This electrically connects the battery 32 with the sound IC 38, and also with the lighting IC 40 through the diode 50 as shown in FIG. 2. The sound IC 38 sends a signal to the loudspeaker 28 causing it to produce a particular sound, and the lighting IC 40 operates in the same manner described above to illuminate the LEDs 24. Both the sound IC 38 and lighting IC 40 are operative to turn off the loudspeaker 28 and LEDs 24, respectively, after a predetermined period at which time they reset in preparation for another sequence of operation.

In the embodiment of this invention shown in FIG. 2, closure of the spring switch 36 is effective to operate only the lighting IC 40. The diode 50 does not conduct when connected to the battery 32 through the spring switch 36. Consequently, when a child is walking, running or otherwise applying motion or an inertial force on the shoe 10 and spring switch 36, only the LEDs 24 are illuminated and no sound is produced. Upon placement of the permanent magnet 62 into proximity with the reed switch 34, as discussed above, closure of the reed switch 34 results in the activation of both the sound IC 38 and lighting IC 40 since the diode 50 conducts when connected to the battery 32 through reed switch 34. The LEDs 24 and loudspeaker 28 are therefore operated at the same time by the magnet 62, and the loudspeaker 28 is operated only in response to closure of the reed switch 34.

Figure 3:
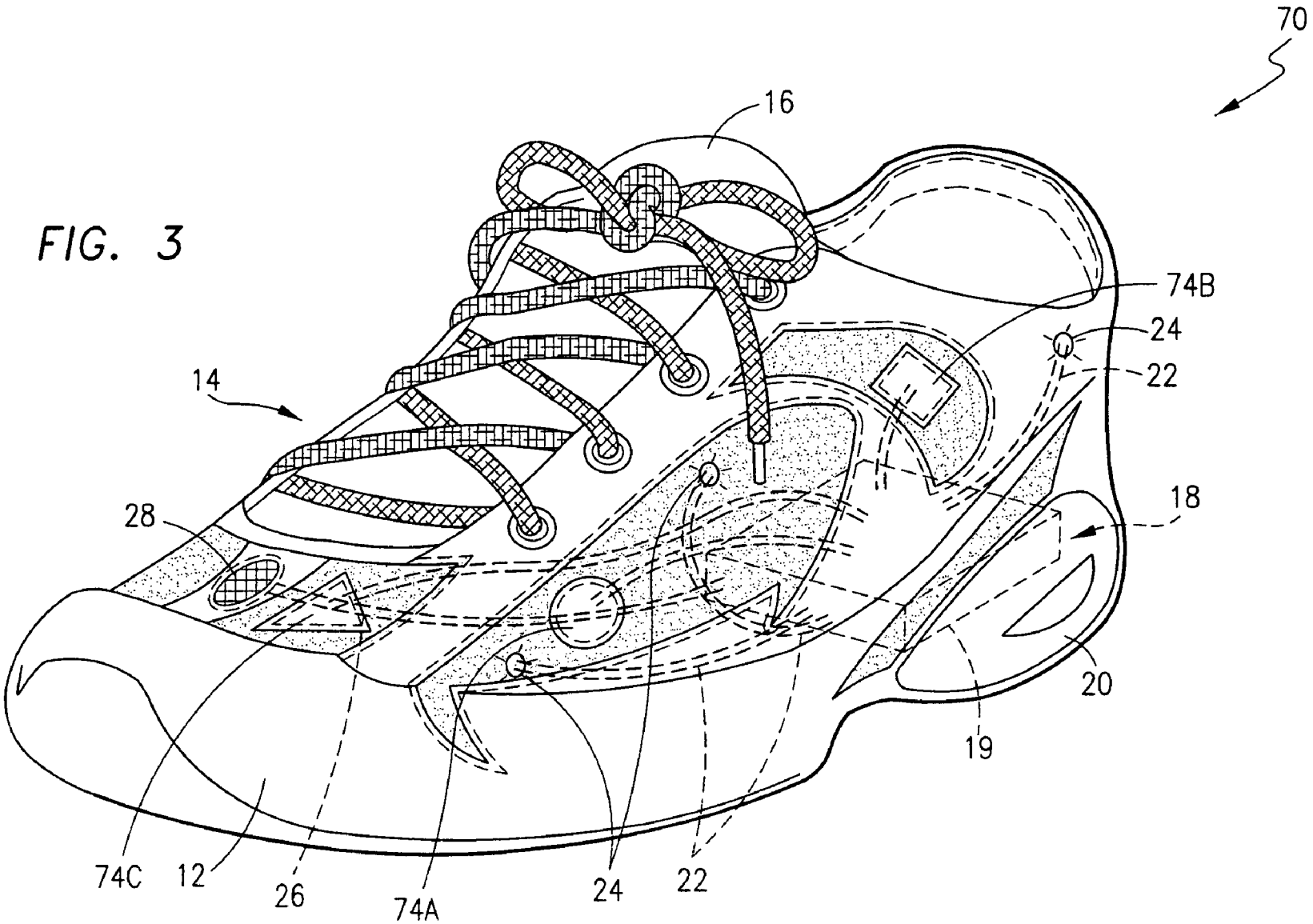
FIG. 3 is a view similar to FIG. 1 except of an alternative embodiment employing indicia mounted to the upper of the shoe.
Figure 4:
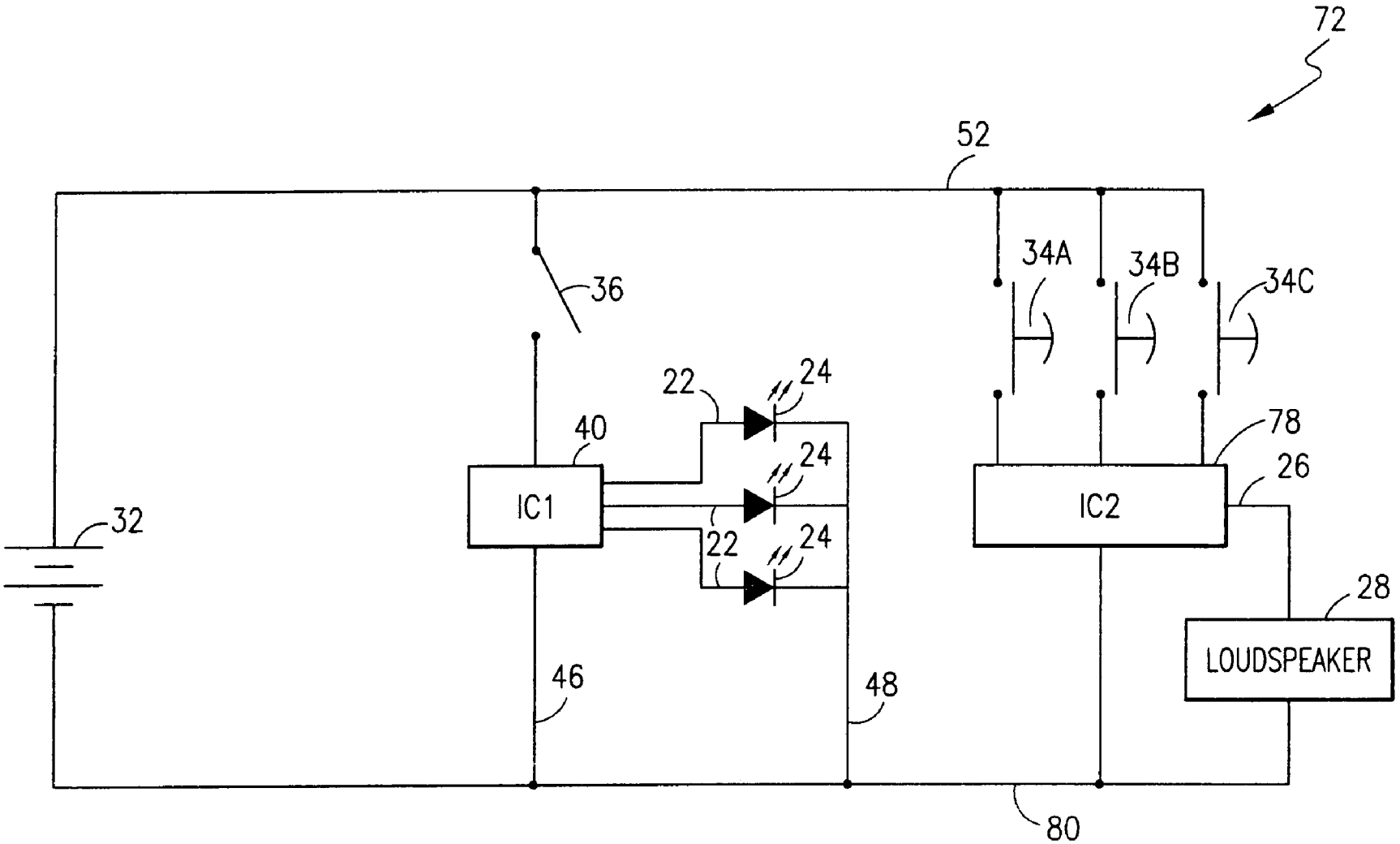
FIG. 4 is a schematic circuit diagrams of the electrical circuit employed with the embodiment of FIG. 3.

Referring now to FIGS. 3 and 4, an alternative embodiment of a shoe 70 and an electrical circuit 72 according to this invention are illustrated. Many of the same elements are employed in the shoe 70 and circuit 72 as in the embodiment of FIGS. 1 and 2, and therefore the same reference numbers are used in FIGS. 3 and 4 to identify structure common to FIGS. 1 and 2.

The shoe 70 of FIGS. 3 and 4 has the same module 18, array of LEDs 24 and loudspeaker 28 as described above, but with the addition of a number of indicia. For purposes of the present discussion, three indicia 74A, 74B and 74C are shown, each of which is comprised of a section of material such as cloth, plastic or the like mounted to the upper 14 of the shoe 70. The indicia 74A, 74B and 74C are formed in the shape of a circle, square and triangle, respectively. It should be understood that the indicia 74A-C could be formed in different shapes, a shape could be marked on or otherwise affixed thereto instead of the indicia 74A-C themselves being formed in such shapes, and, there could be more or less than three indicia, as desired.

Each of the indicia 74A, 74B and 74C is associated with a reed switch 34A, 34B and 34C, respectively. The reed switches 34A-C may comprise the indicia, i.e. their housing 42 depicted in FIG. 5 could be made in a particular shape, or, alternatively, the reed switches 34A-C may be mounted to the upper 14 of the shoe 70 beneath a section of material forming the indicia 74A-C. In either case, the reed switches 34A-C are coupled by a line 76 to one terminal of the battery 32, and to a sound IC 78 as shown in FIG. 4. The sound IC 78 is coupled to loudspeaker 28, which, in turn, is coupled to the opposite terminal of the battery 32 by a line 80. The detailed construction of the sound IC 78 forms no part of this invention and is therefore not discussed herein. The sound IC 78 is available under part number 66391 from Cheerine Development (Hong Kong) Ltd., having a place of business at Room 1217, North Tower, Concordia Plaza, No. 1 Science Museum Road, Tsim Sha Tsui East, Kowloon, Hong Kong.

The shoe 70 and electrical circuit 72 of this embodiment of the subject invention operate as follows. Illumination of the LEDs 24 by operation of spring switch 36 and lighting IC 40 is accomplished in the same manner as that described above in connection with a discussion of FIGS. 1 and 2. However, no reed switch 34 is employed in this embodiment to activate the LEDs.

The indicia 74A, 74B and 74C are provided to add an educational aspect to wearing and playing with the shoe 70. In response to placement of the wand 58 in proximity to one of the indicia 74A-C, and their respective reed switches 34A-C, the sound IC 78 is enabled and causes the loudspeaker 28 to sound a message identifying a particular sequence of the indicia. For example, if the wand 58 is placed near the indicia 74A the loudspeaker 28 may sound the message "triangle, circle, square." The child would then be required to pass the wand 58 over the indicia 74C, 74A and 74B, in that order, to activate the associated switches 34C, 34A and 34B in the same sequence. If he or she is successful in doing that, the sound IC 78 operates to cause the loudspeaker 28 to sound a positive, congratulatory message. On the other hand, if the child does not recognize the shapes of indicia 74A-C and fails to move the wand 58 near the indicia 74A-C in the designated sequence, the sound IC 78 causes the loudspeaker 28 to sound a message such as "try again" or the like.

It is contemplated that the sound integrated circuit 78 can be programmed to allow for more than one iteration of a selected sequence of indicia 74A-C for the child to replicate, before resetting. In such instance, the congratulatory or negative message may be delayed until the child has successfully completed matching each specified sequence by placing the wand 58 over the appropriate indicia 74A-C in the correct order.

The embodiment of FIGS. 3 and 4 therefore not only adds fun for the child in wearing and playing with shoe 70, but provides an educational benefit in helping the child to learn shapes and improve his or her tactile skills in moving the wand 58 from location to location over the appropriate indicia 74A-C.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the embodiment of this invention shown in the FIGS. 1 and 2, a spring switch 36 is connected between the battery 32 and lighting IC 40 so that the LEDs may be illuminated in response to the application of an inertial force or motion to the shoe 10 and independently of the operation of the reed switch 34. In an alternative embodiment, the spring switch 36 is eliminated so that the lighting IC 40 is activated in response to operation of the reed switch 34. In that case, the LEDs 24 and loudspeaker 28 are always activated at the same time, independently of any motion or inertial force applied to the shoe 10.

Additionally, for purposes of the present discussion, operation of the lighting IC 40 and sound ICs 38 and 78 have been described as being responsive to movement of the reed switches 34 and 34A-C, or spring switch 36, from an open position to a closed position. It should be understood that in some designs integrated circuits illuminate LEDs in a particular lighting sequence in response to movement of a switch from the closed position to the open position. See, for example, U.S. Pat. No. 5,903,103. Consequently, reference in the foregoing description and in the appended claims to activation of the sound ICs 38 and 78 and/or lighting IC 40, in response to "closing" of switches 34, 34A-C or 36, is meant to broadly encompass integrated circuit operation which is responsive to movement of the switch from the open position to the closed position or from the closed position to the open position.

In the illustrated embodiments, a "lighting" integrated circuit 40 and "sound" integrated circuits 38, 78 are described as the elements of electrical circuits 30 and 72 which are operative to illuminate the LEDs and sound the loudspeaker 28. Use of the terms "lighting" and "sound" in identifying these components is for convenience and ease of reference to their function. The integrated circuits 38, 40 and 78 are "controllers" in the sense that they control the operation of LEDs 24 and speaker 28. It is contemplated that circuit elements other than integrated circuits could be employed as a controller in circuits 30, 72, and are considered within the scope of this invention. Further, a single integrated circuit may be used to control the operation of both the LEDs 24 and loudspeaker 28, instead of separate ICs as depicted in the FIGS.

Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an outsole, and an upper mounted to said outsole;

an electrical circuit including:

(i) a number of different indicia mounted to at least one of said outsole and said upper;

(ii) a switch coupled to each of said indicia;

(iii) a loudspeaker mounted to at least one of said outsole and said upper; and (iv) a controller coupled to said switches and to said loudspeaker;

a magnet located externally of said outsole and said upper, said magnet being movable into sufficient proximity with each of said switches so that the magnetic field of said magnet can activate each switch independently of one another;

said controller being operative in response to activation of one switch by said magnet to cause said loudspeaker to sound a message specifying a sequence of said indicia, said controller then causing said loudspeaker to sound a positive or negative message dependent on whether said magnet is positioned to activate the switch of each identified indicia in the specified sequence.

2. The article of footwear of claim 1 in which said indicia is a number of sections each having a different shape.

3. The article of footwear of claim 2 in which each of said indicia is a section of different color.

4. The article of footwear of claim 1 in which said controller is a sound integrated circuit.

5. The article of footwear of claim 1 in which said magnet is a permanent magnet mounted to a toy.

6. The article of footwear of claim 1 further including a light integrated circuit and at least one LED coupled to said light integrated circuit, said light integrated circuit being operative to illuminate said at least one LED.

7. The article of footwear of claim 6 further including an inertia switch coupled to said light integrated circuit, said inertia switch being effective to activate said light integrated circuit in response to motion.

8. An article of footwear, comprising:

an outsole, and an upper mounted to said outsole;

an electrical circuit, including:

(i) a number of indicia mounted to at least one of said outsole and said upper;

(ii) a first switch coupled to each of said indicia;

(iii) a loudspeaker mounted to at least one of said outsole and said upper;

(iv) a first controller coupled to each of said first switches and to said loudspeaker;

(v) at least one light source;

(vi) a second switch;

(vii) a second controller coupled to said second switch and to said at least one light source;

a magnet located externally of said outsole and said upper, said magnet being movable into sufficient proximity with each of said first switches so that the magnetic field of said magnet activates said first switches independently of one another;

said first controller being operative in response to activation of one of said first switches by said magnet to cause said loudspeaker to sound a message specifying a sequence of said indicia, said first controller then causing said loudspeaker to sound a positive or negative message dependent on whether said magnet is positioned to activate the first switch of each identified indicia in the specified sequence;

said second switch being effective to activate said second controller which illuminates said at least one light source.

9. The article of clothing of claim 8 in which said first controller is a sound integrated circuit.

10. The article of footwear of claim 8 in which said second controller is a light integrated circuit.

11. The article of footwear of claim 8 in which said indicia is a number of sections each having a different shape.

12. The article of footwear of claim 8 in which each of said indicia is a section of different color.

13. The article of clothing of claim 8 in which said magnet is a permanent magnet mounted to a toy.

14. The article of clothing of claim 8 in which each of said first switches is a reed switch.

15. The article of clothing of claim 8 in which said second switch is an inertia switch.

* * * * *